US006050339A

United States Patent [19]

Milberger

[11] Patent Number: 6,050,339

[45] Date of Patent: Apr. 18, 2000

[54] ANNULUS PORTING OF HORIZONTAL TREE

[75] Inventor: Lionel J. Milberger, Houston, Tex.

[73] Assignee: Abb Vetco Gray Inc., Houston, Tex.

[21] Appl. No.: 08/996,840

[22] Filed: Dec. 23, 1997

Related U.S. Application Data

[60] Provisional application No. 60/036,338, Dec. 6, 1996.

[51] Int. Cl.[7] ..... E21B 33/043

[52] U.S. Cl. ..... 166/368; 166/86.1; 166/88.1; 166/88.4; 166/95.1; 166/348

[58] Field of Search ..... 166/368, 348, 166/86.1, 88.1, 89.1, 88.4, 95.1, 97.1, 75.14, 90.1

[56] References Cited

U.S. PATENT DOCUMENTS 5,372,199 12/1994 Cegielski et al. ..... 166/368
5,544,707 8/1996 Hopper et al. ..... 166/382
5,575,336 11/1996 Morgan ..... 166/330
5,868,204 2/1999 Pritchett et al. ..... 166/368
5,884,706 3/1999 Edwards ..... 166/335

*Primary Examiner*—Hoang Dang
*Attorney, Agent, or Firm*—James E. Bradley

[57] ABSTRACT

A horizontal tree has a vertical bore and a horizontal production passage and is landed in a wellhead housing. A tubing hanger lands in the bore and has a vertical passage and a horizontal passage that aligns with that of the tree. A retrievable first plug seals the vertical passage. A tree cap seals in the tree bore above the tubing hanger and has an axial passage. A retrievable second plug seals the tree cap passage. A vent port extends laterally through the tree cap between its axial passage and outer surface. A pair of seals on the second plug seal above and below the vent port. A tubing annulus passage communicates with the vent port and an annulus passage. The second plug serves as a second pressure barrier to the first plug and blocks the vent port. The annulus passage is sealed from communication with a void between the plugs.

7 Claims, 2 Drawing Sheets

ANNULUS PORTING OF HORIZONTAL TREE

This application claims the benefit of Provisional Appln No. 60/036,338, filed Dec. 6, 1996.

TECHNICAL FIELD

This invention relates in general to oil and gas well Christmas trees, and in particular to a tree cap for a horizontal tree.

BACKGROUND ART

One type of wellhead assembly, particularly used offshore, is known as a horizontal tree. The well has a wellhead housing which contains casing hangers, each secured to a string of production casing that extends into the well. The tree mounts on top of the wellhead housing. The tree has a vertical bore and a horizontal or lateral production flow outlet. A tubing hanger lands in the bore of the tree and is secured to a string of production tubing extending through the casing hangers and into the well. The tubing hanger has a lateral flow passage that registers with the lateral passage of the horizontal tree.

A plug, normally wireline retrievable, fits in the vertical passage of the tubing hanger above the horizontal passage. A tree cap fits above the tubing hanger in the bore of the tree. The tree cap may have a vertical passage within which the retrievable plug fits. A corrosion cap fits over the upper end of the tree.

A tubing annulus between the tubing and the casing communicates to a lower annulus port formed in the tree. This port leads through an annulus passage to an upper annulus port which extends into the bore of the tree above the tubing hanger seals. One or more valves are used to open and close the tubing annulus. The upper tubing annulus port communicates with a void that is located between the tubing hanger wireline plug and the seal of the internal tree cap.

SUMMARY OF THE INVENTION

A horizontal tree has a vertical bore and a horizontal production passage and is landed in a wellhead housing. A tubing hanger lands in the bore and has a vertical passage and a horizontal passage that aligns with that of the tree. A retrievable first plug seals the vertical passage. A tree cap seals in the tree bore above the tubing hanger and has an axial passage. A retrievable second plug seals the tree cap passage. A vent port extends laterally through the tree cap between its axial passage and outer surface. A pair of seals on the second plug seal above and below the vent port. A tubing annulus passage communicates with the vent port and an annulus passage. The second plug serves as a second pressure barrier to the first plug and blocks the vent port. The annulus passage is sealed from communication with a void between the plugs.

BEST MODE FOR CARRYING OUT THE INVENTION

Figure 1:
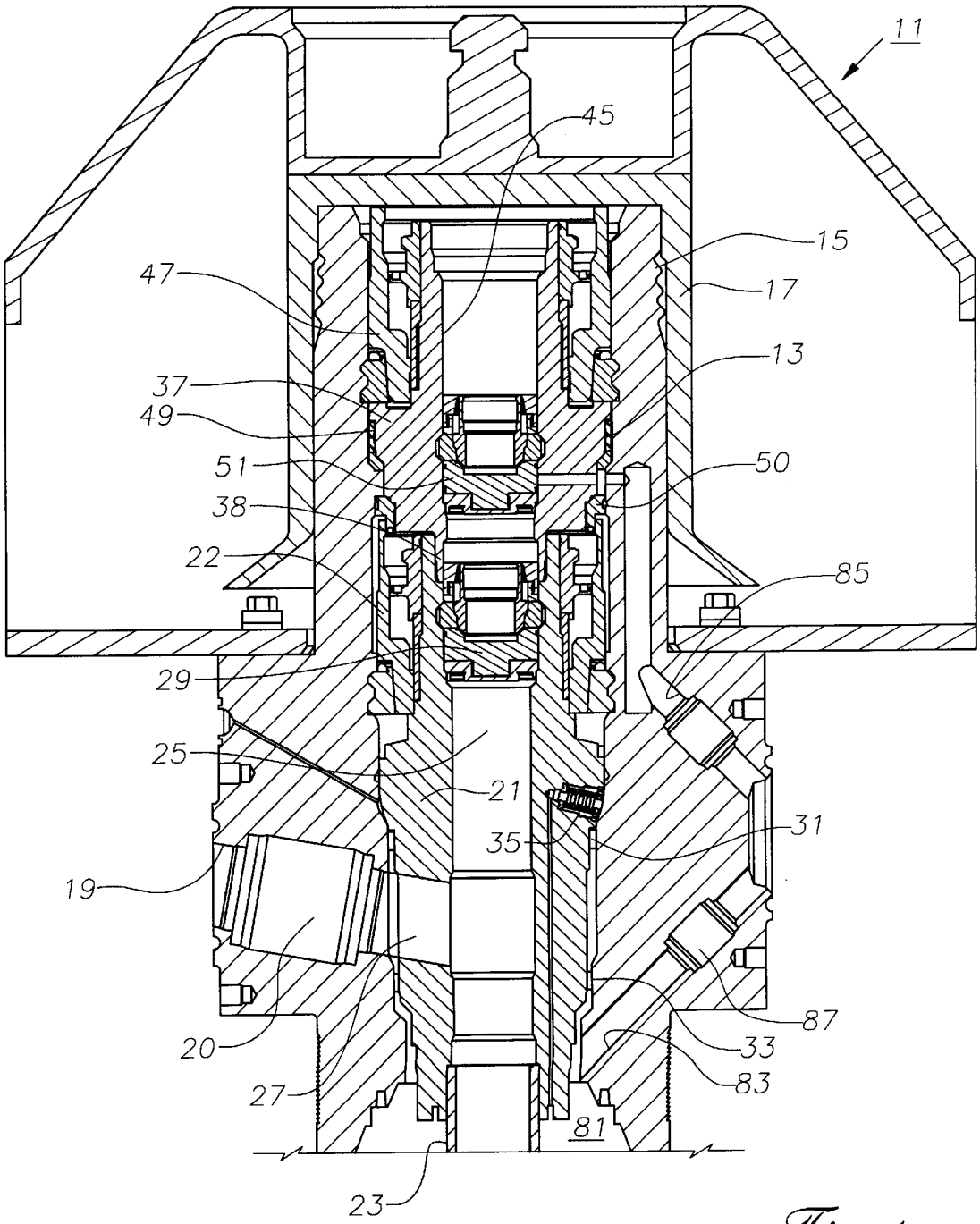
FIG. 1 is a vertical sectional view of a portion of a horizontal tree constructed in accordance with the invention.

Referring to FIG. 1, christmas tree 11 is of a type known as a horizontal tree. It has a vertical or axial tree bore 13 extending completely through it. A set of grooves 15 are located on the exterior near the upper end for connection to a drilling riser (not shown). A removable corrosion cover 17 fits over the upper end of tree 11. Tree 11 has a lateral production passage 19 that extends generally horizontally from bore 13 and is controlled by a valve 20. Tree 11 will be landed on top of a wellhead housing (not shown) which has casing extending into a well.

A tubing hanger 21 lands sealingly in bore 13. Tubing hanger 21 is secured to tree 11 by a lock down mechanism 22. A string of production tubing 23 extends through the casing hangers (not shown) into the well for the flow of production fluid. Production tubing 23 communicates with a vertical passage 25 that extends through tubing hanger 21. A lateral passage 27 extends from vertical passage 25 and aligns with tree lateral passage 19.

A wireline retrievable plug 29 will lock in vertical passage 25, sealing the upper end of vertical passage 25. Tubing hanger 21 has an upper seal 31 located above lateral passage 27 and a lower seal 33 located below lateral passage 27. Seals 31 and 33 seal to bore 13 of tree 11. Radial ports 35 in tubing hanger 21 are used to communicate hydraulic fluid to a downhole safety valve. These ports register with passages (not shown) formed in tree 11.

A tree cap 37 inserts sealingly into tree bore 13 above tubing hanger 21. Tree cap 37 may have an axial passage 45 that extends through tree cap 37. Axial passage 45 has the same inner diameter as tubing hanger passage 25. A locking mechanism 47 similar to that of tubing hanger locking mechanism 22 is used to lock tree cap 37 to tree 11. Tree cap 37 is sealed to tree bore 13 with an upper seal 49 and a lower seal 50. Lower seal 50 has a smaller outer diameter than upper seal 49. Tree cap 37 has a depending neck 38 which inserts into a receptacle in the top of axial passage 25 in tubing hanger 21. Neck 38 does not seal in passage 25 so that a clearance therebetween is maintained.

Figure 2:
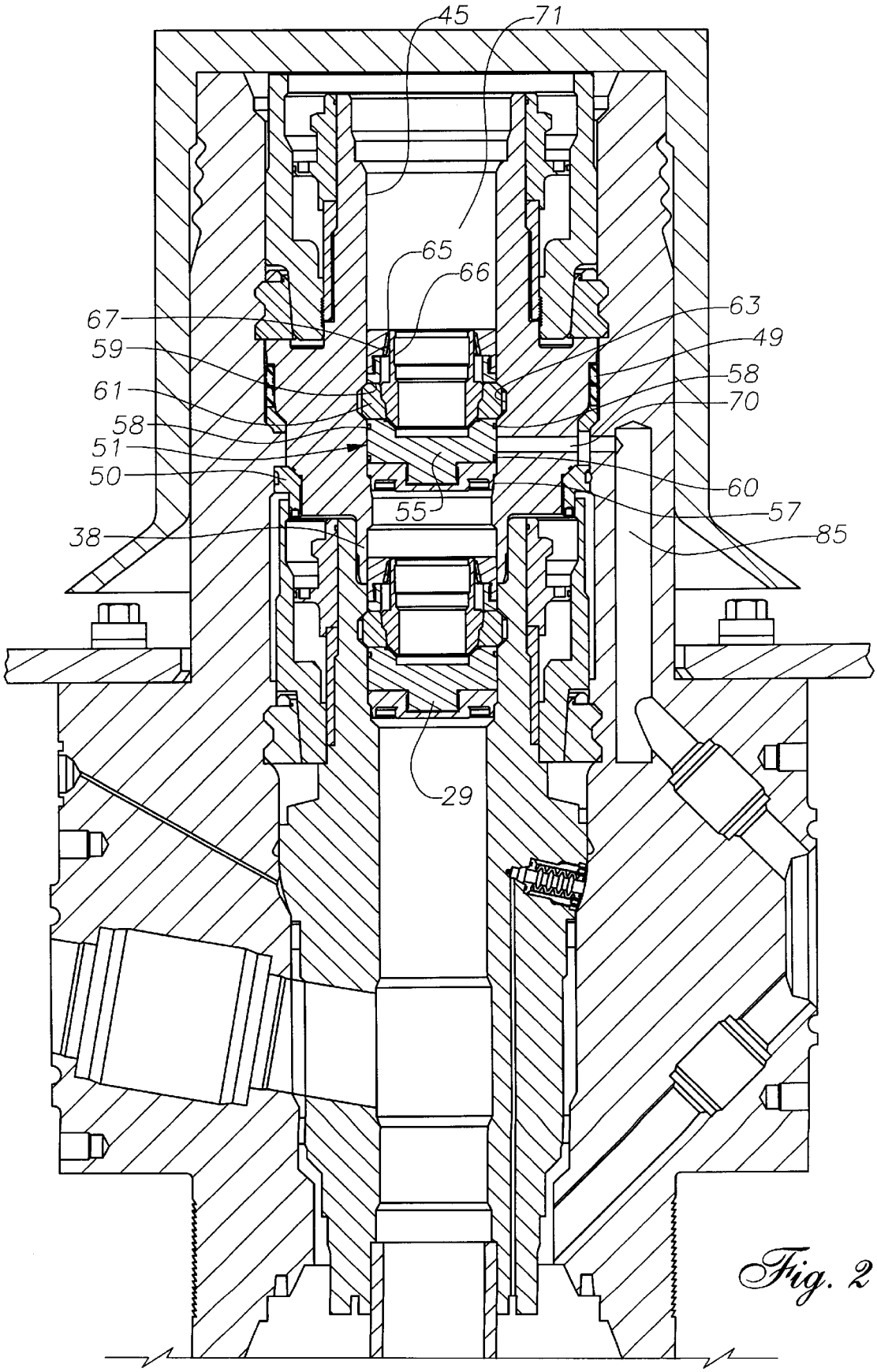
FIG. 2 is an enlarged view of an upper portion of the horizontal tree of FIG. 1.

As shown in FIG. 2, a wireline retrievable crown plug 51 inserts into tree cap passage 45. Crown plug 51 has body 55 which has a metal seal 57 secured to its lower end. Seal 57 is a depending lip that seals against a tapered surface formed in tree cap passage 45. A vent port 70 extends laterally through internal tree cap 37 from axial passage 45 to its outer surface. Body 55 has a pair of circumferencial seals 58, 60 near its midsection above seal 57. Seals 58, 60 are located above and below a vent port 70 in passage 45, respectively. Vent port 70 extends laterally through the sidewall of tubing hanger 21.

Body 55 has a plurality of windows 59 which allows dogs 61 to protrude through. When in the outer locked position, dogs 61 will engage a groove 63 in tree cap passage 45. A cam member 65 is carried reciprocally within body 55. When in the lower position, cam member 65 keeps dogs 61 in the outer locked position. When cam member 65 is pulled upward, it will allow dogs 61 to retract from groove 63. Cam member 65 has a profile 66 on its upper end to allow engagement of a running and retrieval tool (not shown). A retainer 67 secures to the upper end of body 55 to retain cam member 65.

Referring again to FIG. 1, a tubing annulus 81 surrounds tubing 23 between tubing 23 and the smallest diameter string of casing (not shown). Tubing annulus 81 communicates with a lower annulus passage 83 that extends from tree bore 13 through the wall of tree 11 below tubing hanger seal 33. Lower annulus passage 83 communicates with an upper annulus passage 85 that extends into tree bore 13 above tubing hanger seal 31 and below locking mechanism 47.

Referring to FIG. 2, passage 85 leads to the vent port 70 between both sets of upper and lower seals 49, 50 and 58, 60. Passage 85 communicates with port 70 which joins axial passage 45. Valves 87 are located in the tubing annulus passages 83 and 85.

In operation, after the well is drilled and cased, horizontal tree 11 will be landed and connected to the wellhead housing (not shown). Tubing 23 will be lowered into the well on tubing hanger 21. Horizontal passage 27 will orient with passage 19 when tubing hanger 21 lands in tree 11. Wireline plug 29 will be installed in tubing hanger vertical passage 25.

Preferably, crown plug 51 will be installed in tree cap 37 and pressure tested while tree cap 37 is at the drilling rig. Tree cap 37 will be lowered on a running tool on drill pipe. Crown plug 51 serves as a second pressure barrier to wireline plug 29 and blocks port 70. Passage 85 does not communicate with a void located between plugs 29, 51 because of lower seals 50 and 57. Since neck 38 does not seal against vertical passage 25, the void between plugs 29, 51 communicates with bore 13 below seal 50. However, seal 50 blocks communication of the void with annulus 81.

For a workover operation requiring the pulling of tubing 23, the operator may use a drilling riser and blowout preventer stack (not shown). After removal of corrosion cover 17, the drilling riser will connect to profile 15. Normally, a kill fluid will be circulated into the well which is heavier than the well fluid to prevent a blowout. The operator will land a running tool on and pull internal tree cap 37 and run back in with an inner riser string (not shown) which secures to the upper end of tubing hanger 21. Upper tubing annulus passage 85 now communicates with an annulus surrounding the inner riser, which in turn communicates with choke and kill lines leading alongside the riser back to the drilling rig. The operator will pull wireline plug 29 with a wireline tool. A port (not shown) at the lower end of tubing 23 will be opened to communicate the interior of tubing 23 with tubing annulus 81. This may be done with a wireline tool in a conventional manner. With production valve 20 closed and tubing annulus valve 87 open, the operator can pump down the inner riser, down tubing 23 and back up tubing annulus 81. The annulus fluid circulates through annulus passages 83, 85 up tree bore 13 and through the choke and kill lines to the surface. After the kill fluid has been placed in the well, the operator may pull production tubing 23.

Under some circumstances, an operator may wish to achieve wireline intervention into tubing 23 without killing the well and without using the drilling riser. Wireline access is achievable with the well under flowing conditions. A wireline riser (not shown) will be installed in the upper portion of passage 45 of tree cap 37. The operator can use a wireline tool to engage crown plug 51. The operator will retrieve plugs 29 and 51 in a conventional manner to perform the wireline intervention.

The invention has several advantages. The tubing annulus has sealed barriers in the internal tree cap and the crown plug. The void between the plugs is isolated from the tubing annulus.

While the invention has been shown in only one of its forms, it should be apparent to those skilled in the art that it is not so limited, but is susceptible to various changes without departing from the scope of the invention.

I claim:

1. A wellhead assembly, comprising in combination:

a christmas tree having an axial bore and a lateral production passage;

a tubing hanger landed in the bore of the tree and having an axial bore and a lateral opening that aligns with the lateral production passage in the tree;

a retrievable first plug landed in the bore of the tubing hanger above the lateral opening;

an internal tree cap assembly having an axial passage and landed in the bore of the tree above the tubing hanger;

a pair of seals axially spaced apart for sealing the internal tree cap assembly in the bore of the tree;

a tubing annulus passage extending through the tree to the bore in the tree above the tubing hanger;

a retrievable second plug landed in the axial passage of the internal tree cap assembly;

a tubing annulus port extending from the axial passage of the internal tree cap assembly through the internal tree cap assembly between the pair of seals and in communication with the tubing annulus passage; and wherein a lower seal of the pair of seals separates the tubing annulus port from the first plug.

2. The wellhead assembly of claim 1 wherein the tubing annulus port extends from an exterior surface of the internal tree cap to the axial passage; and wherein the retrievable second plug blocks the tubing annulus port; and wherein the wellhead assembly further comprises:

a seal on the second plug for sealing the axial passage above the tubing annulus port.

3. The wellhead assembly of claim 1 wherein the tubing annulus port extends from an exterior surface of the internal tree cap to the axial passage; and wherein the retrievable second plug blocks the tubing annulus port; and wherein the wellhead assembly further comprises:

an upper seal on the second plug for sealing the axial passage above the tubing annulus port; and a lower seal on the second plug for sealing the axial passage below the tubing annulus port.

4. The wellhead assembly of claim 1 wherein the tubing annulus port extends laterally through a sidewall of the internal tree cap from an exterior surface to the axial passage; and wherein the retrievable second plug blocks the tubing annulus port; and wherein the wellhead assembly further comprises:

a seal on the second plug for sealing the axial passage above the tubing annulus port.

5. A wellhead assembly, comprising in combination:

a christmas tree having an axial bore and a lateral production passage;

a tubing hanger landed in the bore of the tree and having a lateral opening that aligns with the lateral production passage in the tree and an axial bore;

a retrievable first plug landed in the bore of the tubing hanger above the lateral opening;

an internal tree cap landed in the bore of the tree above the tubing hanger and having an axial passage;

upper and lower seals located between the internal tree cap and the tree;

a vent port extending through the internal tree cap from an exterior sidewall to the axial passage between the upper and lower seals;

a tubing annulus passage in the tree which registers with the vent port;

a retrievable second plug landed in the axial passage of the tree cap; and seals on the second plug which seal a junction of the vent port with the axial passage.

6. The wellhead assembly of claim 5 wherein the seals on the second plug comprise upper and lower seals on the second plug which locate above and below the vent port.

7. A method for providing a tubing annulus access in a wellhead assembly having a tree, a tubing hanger and a first plug, comprising:

providing an internal tree cap with an axial passage and a lateral vent port extending through a sidewall to the axial passage, the vent port registering with an annulus passage extending through the tree from the tubing annulus;

landing and sealing the internal tree cap in the tree; and then landing and sealing a second plug in the internal tree cap adjacent to the vent port such that the second plug seals the vent port from communication with the axial passage.

* * * * *